US009135909B2

(12) United States Patent
Iriyama

(10) Patent No.: US 9,135,909 B2
(45) Date of Patent: Sep. 15, 2015

(54) SPEECH SYNTHESIS INFORMATION EDITING APPARATUS

(75) Inventor: Tatsuya Iriyama, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 298 days.

(21) Appl. No.: 13/309,258

(22) Filed: Dec. 1, 2011

(65) Prior Publication Data

US 2012/0143600 A1 Jun. 7, 2012

(30) Foreign Application Priority Data

Dec. 2, 2010 (JP) ..... 2010-269305

(51) Int. Cl.
*G10L 13/08* (2013.01)

(52) U.S. Cl.
CPC ..... *G10L 13/08* (2013.01)

(58) Field of Classification Search
CPC . G10L 13/033; G10L 13/087; G10L 2013/02; G10L 2013/08; G10L 2013/105
USPC ..... 704/258–269, 270, 276, 278
See application file for complete search history.

(56) References Cited

U.S. PATENT DOCUMENTS 5,796,916 A * 8/1998 Meredith ..... 704/258
5,860,064 A * 1/1999 Henton ..... 704/260
5,940,797 A * 8/1999 Abe ..... 704/260
6,006,187 A * 12/1999 Tanenblatt ..... 704/260
6,029,131 A * 2/2000 Bruckert ..... 704/260
6,088,674 A * 7/2000 Yamazaki ..... 704/266
6,470,316 B1 * 10/2002 Chihara ..... 704/267
6,970,819 B1 * 11/2005 Tabei ..... 704/256
2003/0004723 A1 * 1/2003 Chihara ..... 704/260
2006/0015344 A1 * 1/2006 Kemmochi ..... 704/267
2006/0085196 A1 * 4/2006 Kayama et al. ..... 704/267
2006/0085197 A1 * 4/2006 Kayama et al. ..... 704/267
2006/0085198 A1 * 4/2006 Kayama et al. ..... 704/267
2008/0167875 A1 * 7/2008 Bakis et al. ..... 704/258
2008/0235025 A1 9/2008 Murase et al.

(Continued)

FOREIGN PATENT DOCUMENTS

EP 0 688 010 A1 12/1995
EP 0688010 A1 * 12/1995

(Continued)

OTHER PUBLICATIONS

Korean Office Action with English Translation dated Sep. 26, 2013 (nine (9) pages).

(Continued)

*Primary Examiner* — Michael N Opsasnick
(74) *Attorney, Agent, or Firm* — Crowell & Moring LLP

(57) ABSTRACT

A speech synthesis information editing apparatus is provided. The speech synthesis information editing apparatus includes a phoneme storage unit that stores phoneme information, which designates a duration of each phoneme of speech to be synthesized. The speech synthesis information editing apparatus also includes a feature storage unit that stores feature information, which designates a time variation in a feature of the speech. In addition, the speech synthesis information editing apparatus includes an edition processing unit that changes a duration of each phoneme designated by the phoneme information with an expansion/compression degree, based on a feature designated by the feature information in correspondence to the phoneme.

18 Claims, 5 Drawing Sheets

(56) References Cited

U.S. PATENT DOCUMENTS

| | | | | |
|---|---|---|---|---|
| 2010/0066742 | A1* | 3/2010 | Qian et al. | 345/440.1 |
| 2010/0312565 | A1* | 12/2010 | Wang et al. | 704/260 |
| 2012/0143600 | A1* | 6/2012 | Iriyama | 704/207 |

FOREIGN PATENT DOCUMENTS

| | | | |
|---|---|---|---|
| JP | 63-246800 | A | 10/1988 |
| JP | 6-67685 | A | 3/1994 |
| JP | 11-507740 | A | 7/1999 |
| JP | 2005-283788 | A | 10/2005 |
| JP | 2008-268477 | A | 11/2008 |
| JP | 2008268477 | A * | 11/2008 |
| JP | 2010-517101 | A | 5/2010 |
| WO | WO 96/42079 | A1 | 12/1996 |
| WO | WO 9642079 | A1 * | 12/1996 |
| WO | WO 2008/092085 | A2 | 7/2008 |

OTHER PUBLICATIONS

European Search Report dated Mar. 14, 2012 (Six (6) pages).
Japanese Office Action dated Jul. 22, 2014 with English translation (five pages).
European Office Action dated Dec. 19, 2014 (Five (5) pages).
Chinese Office Action dated Dec. 29, 2014 with English-language translation (Fourteen (14) pages).

* cited by examiner

SPEECH SYNTHESIS INFORMATION EDITING APPARATUS

BACKGROUND OF THE INVENTION

1. Technical Field of the Invention

The present invention relates to a technology for editing information (speech synthesis information) used for speech synthesis.

2. Description of the Related Art

In a conventional speech synthesis technology, the duration of each phoneme of speech that becomes an object of synthesis (hereinafter referred to as synthetic speech) is designated to be variable. Japanese Patent Application Publication No. Hei06-67685 describes a technology for increasing/decreasing the duration of each phoneme at an expansion/compression degree depending on phoneme type (vowel/consonant) when a time series of phonemes specified from a target arbitrary character string is instructed to be expanded or compressed on the time base.

However, since the duration of each phoneme in real speech does not depend only on phoneme type, it is difficult to synthesize auditorily natural speech in a configuration in which the duration of each phoneme is expanded/compressed at an expansion/compression degree depending only on phoneme type as described in Japanese Patent Application Publication No. Hei06-67685.

SUMMARY OF THE INVENTION

In view of these circumstances, it is an object of the invention to generate speech synthesis information capable of synthesizing auditorily natural speech (furthermore, synthesizing natural speech) even in the case where expansion/compression are performed on the time base.

The invention employs the following means in order to achieve the object. Although, in the following description, elements of the embodiments described later corresponding to elements of the invention are referenced in parentheses for better understanding, such parenthetical reference is not intended to limit the scope of the invention to the embodiments.

A speech synthesis information editing apparatus according to a first aspect of the invention comprises: a phoneme storage unit (for example, a storage device 12) that stores phoneme information (for example, phoneme information SA) that designates a duration of each phoneme of speech to be synthesized; a feature storage unit (for example, the storage device 12) that stores feature information (for example, feature information SB) that designates a time variation in a feature of the speech; and an edition processing unit (for example, an edition processor 24) that changes a duration of each phoneme designated by the phoneme information with an expansion/compression degree (for example, expansion/compression degree K(n)) depending on a feature designated by the feature information in correspondence to the phoneme. In this configuration, it is possible to generate speech synthesis information capable of synthesizing auditorily natural speech since the duration of a corresponding phoneme is changed (expanded/compressed) at the expansion/compression degree depending on the feature of each phoneme, as compared to a configuration in which the expansion/compression degree is set depending only on phoneme type.

For example, in a configuration in which feature information designates a time variation in a pitch, when the speech to be synthesized is expanded, it is preferable that the edition processing unit sets the expansion/compression degree to be variable depending on the feature, such that a degree of expansion of the duration of the phoneme increases as a pitch of the phoneme designated by the feature information becomes higher. In this aspect, it is possible to generate natural speech to which a tendency to increase a degree of expansion as a pitch increases has been applied. In addition, when the synthetic speech is compressed, the edition processing unit may set the expansion/compression degree to be variable depending on the feature when the speech is compressed, such that a degree of compression of the duration of the phoneme increases as a pitch of the phoneme designated by the feature information becomes lower. In this aspect, it is possible to generate natural speech to which a tendency to increase a degree of compression as a pitch decreases has been applied.

In addition, in a configuration in which the feature information designates a time variation in dynamics, when the synthetic speech is expanded, it is desirable that the edition processing unit sets the expansion/compression degree to be variable depending on the feature, such that a degree of expansion of the duration of the phoneme increases as a dynamics of the phoneme designated by the feature information becomes greater. In this aspect, natural speech to which a tendency to increase a degree of expansion as a dynamics increases has been applied is generated. Furthermore, when the synthetic speech is compressed, the edition processing unit sets the expansion/compression degree to be variable depending on the feature, such that a degree of compression of the duration of the phoneme increases as a dynamics of the phoneme designated by the feature information becomes smaller. According to this aspect, it is possible to generate natural speech to which a tendency to increase a degree of compression as the dynamics decreases has been applied.

Meantime, a relationship between the feature and the expansion/compression degree is not limited to the above examples. For example, the expansion/compression degree is set such that a degree of expansion decreases for a phoneme having a high pitch on the assumption that a degree of expansion increases as a pitch decreases, and the expansion/compression degree is set such that a degree of expansion decreases for a phoneme having a large dynamics on the assumption that a degree of expansion decreases as a dynamics increases.

A speech synthesis information editing apparatus according to a preferred embodiment of the invention further comprises a display control unit that displays an edit screen containing a phoneme sequence image (for example, a phoneme sequence image 32) and a feature profile image (for example, a feature profile image 34) on a display device, the phoneme sequence image being a sequence of phoneme indicators (for example, phoneme indicators 42) arranged along a time base in correspondence to the phonemes of the speech, each phoneme indicator having a length set according to the duration designated by the phoneme information, the feature profile image representing a time series of the feature designated by the feature information and arranged along the same time base, and that updates the edit screen based on a processing result of the edition processing unit. In this aspect, a user can be intuitively aware of expansion/compression of each phoneme since the phoneme sequence image and the feature profile image are displayed on the display device on the common time base.

In a preferred aspect of the invention, the feature information specifies a feature for each of editing points (for example, editing points $\alpha$) of the phonemes arranged on the time base, and the edition processing unit updates the feature information such that a position of the editing point relative to a sounding interval of the phoneme is maintained before and after change of the duration of each phoneme. According to this aspect, it is possible to expand/compress each phoneme while maintaining the positions of editing points on the time base in the sounding interval of each phoneme.

In a preferred aspect of the invention, the edition processing unit moves a position of the editing point on the time base within the sounding interval of the phoneme represented by the phoneme information by an amount depending on a type of the phoneme when the time variation in the feature is updated. In this aspect, since the editing point position on the time base is moved by the amount depending on the type of the phoneme corresponding to the editing point, it is possible to easily achieve a complicated edition process in which a movement amount of an editing point for a vowel phoneme is different from a movement amount of an editing point for a consonant phoneme on the time base. Accordingly, a burden on the user to edit a time variation in a feature is alleviated. A detailed example of this aspect is described as a second embodiment later.

A conventional speech synthesis technology for allowing a user to designate a time variation in a feature (for example, pitch) of synthetic speech has been already proposed. A time variation in a feature is displayed as a broken line that connects a plurality of editing points (break points) arranged on the time base on the display device. However, a user needs to move editing points individually in order to change (edit) the time variation in the feature, and thus a burden on the user increases. In view of this circumstance, a speech synthesis information editing apparatus of a second embodiment of the invention comprises: a phoneme storage unit (for example, a storage device 12) that stores phoneme information (for example, phoneme information SA) that designates a plurality of phonemes arranged on a time base to constitute speech to be synthesized; a feature storage unit (for example, the storage device 12) that stores feature information (for example, feature information SB) that designates a feature of the speech at editing points (for example, editing points a [m]) being arranged on the time base and being allocated to the phonemes; and an edition processing unit (for example, an edition processor 24) that moves a position of the editing point (for example, an editing point $\alpha$ [m]) on the time base within a sounding interval of the phoneme by an amount (for example, amount $\delta$ T[m]) depending on a type of the phoneme in the direction of the time base. According to this configuration, since the editing point position on the time base is moved by the amount depending on the type of the phoneme corresponding to the editing point, it is possible to easily achieve a complicated edition process in which a movement amount of an editing point for a vowel phoneme is different from a movement amount of an editing point for a consonant phoneme on the time base. Accordingly, a burden on the user to edit a time variation in a feature is alleviated. A detailed example of this aspect is described as a second embodiment later.

The speech synthesis information editing apparatuses in the above aspects are implemented by hardware (electronic circuits) such as a Digital Signal Processor (DSP) exclusively used to generate speech synthesis information, and also implemented by cooperation of a general purpose arithmetic processing apparatus such as a Central Processing Unit (CPU) and a program. A program according to a first aspect of the invention is executable by the computer to perform a speech synthesis information editing process comprising: providing phoneme information that designates a duration of each phoneme of speech to be synthesized; providing feature information that designates a time variation in a feature of the speech; and changing a duration of each phoneme designated by the phoneme information with an expansion/compression degree depending on a feature designated by the feature information in correspondence to the phoneme. In addition, a program according to a second aspect of the invention is executable by the computer to perform a speech synthesis information editing process comprising: providing phoneme information that designates a plurality of phonemes arranged on a time base to constitute speech to be synthesized; providing feature information that designates a feature of the speech at editing points being arranged on the time base and being allocated to the phonemes; and moving a position of the editing point on the time base within a sounding interval of the phoneme by an amount depending on a type of the phoneme in the direction of the time base. According to the programs of the above aspects, the same operation and effect as those of the speech synthesis information editing apparatus of the invention are obtained. The programs of the invention are stored in a computer readable recording medium, provided to a user and installed in a computer. In addition, the programs are provided from a server device in a transmission form via a communication network and installed in a computer.

The present invention is specified as a method for generating speech synthesis information. A speech synthesis information editing method of a first aspect of the invention comprises: providing phoneme information that designates a duration of each phoneme of speech to be synthesized; providing feature information that designates a time variation in a feature of the speech; and changing a duration of each phoneme designated by the phoneme information with an expansion/compression degree depending on a feature designated by the feature information in correspondence to the phoneme. In addition, a speech synthesis information editing method of a second aspect of the invention comprises: providing phoneme information that designates a plurality of phonemes arranged on a time base to constitute speech to be synthesized; providing feature information that designates a feature of the speech at editing points being arranged on the time base and being allocated to the phonemes; and moving a position of the editing point on the time base within a sounding interval of the phoneme by an amount depending on a type of the phoneme in the direction of the time base. According to the speech synthesis information editing methods of the above aspects, the same operation and effect as those of the speech synthesis information editing apparatus of the invention are obtained.

DETAILED DESCRIPTION OF THE INVENTION

A: First Embodiment

Figure 1:
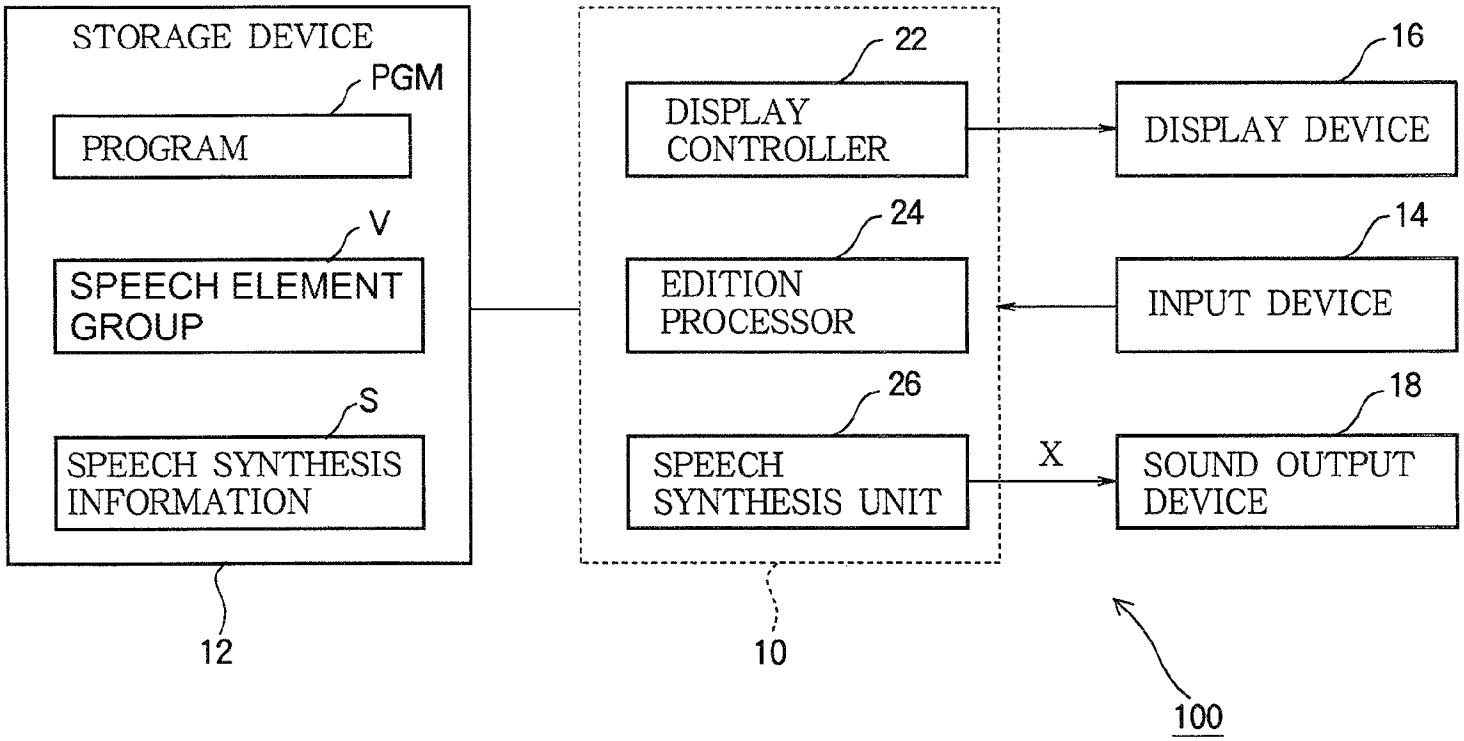
FIG. 1 is a block diagram of a speech synthesis apparatus according to a first embodiment of the invention.

FIG. 1 is a block diagram of a speech synthesis apparatus 100 according to a first embodiment of the invention. The speech synthesis apparatus 100 is a sound processing apparatus that synthesizes desired synthetic speech, and is implemented as a computer system including an arithmetic processing device 10, a storage device 12, an input device 14, a display device 16, and a sound output device 18. The input device 14 (for example, a mouse or a keyboard) receives an instruction from a user. The display device 16 (for example, a liquid crystal display) displays an image designated by the arithmetic processing device 10. The sound output device 18 (for example, a speaker or a headphone) reproduces a sound based on a speech signal X.

The storage device 12 stores a program PGM executed by the arithmetic processing device 10 and information (for example, a speech element group V and speech synthesis information S). A known recording medium such as a semiconductor recording medium or magnetic recording medium, or a combination of recording media of a plurality of type may be arbitrarily employed as the storage device 12.

The speech element group V is a speech synthesis library composed of a plurality of element data (for example, sample series of speech element waveforms) corresponding to different speech elements and used as a material of speech synthesis. A speech element is a phoneme corresponding to a minimum unit for identifying the meaning of a language (for example, vowel or consonant) or a phoneme chain composed of a plurality of connected phonemes. The speech synthesis information S designates phonemes and feature of speech to be synthesized (which will be described in detail later).

The arithmetic processing device 10 implements a plurality of functions (a display controller 22, an edition processor 24, and a speech synthesis unit 26) required to generate the speech signal X by executing the program PGM stored in the storage device 12. The speech signal X represents waveforms of the synthetic speech. While functions of the arithmetic processing device 10 are implemented as dedicated electronic circuits DSP in this configuration, it is possible to employ a configuration in which the functions of the arithmetic processing device 10 are distributed to a plurality of integrated circuits.

Figure 2:
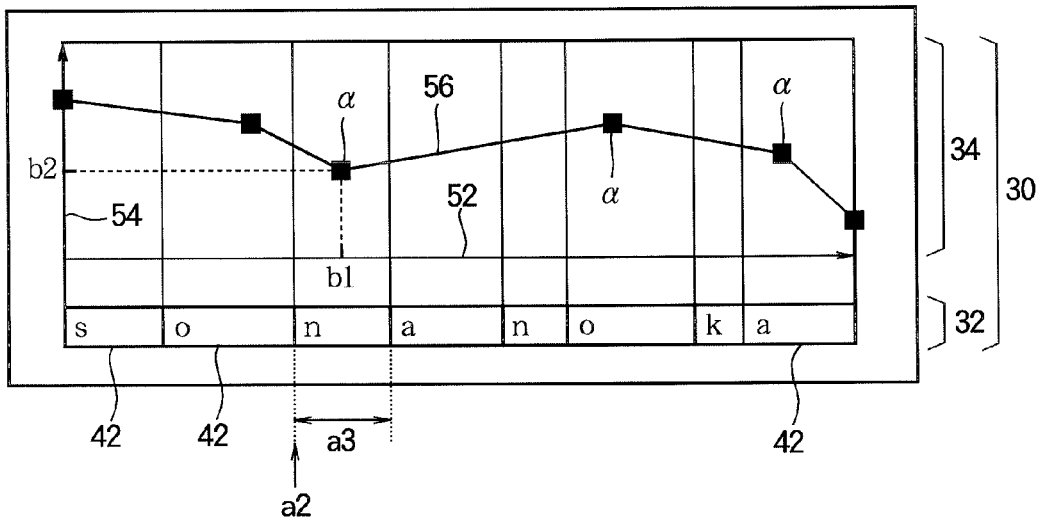
FIG. 2 is a schematic diagram of an edit screen.

The display controller 22 displays an edit screen 30 shown in FIG. 2, visually recognized by the user when editing the speech to be synthesized, on the display device 16. As shown in FIG. 2, the edit screen 30 includes a phoneme sequence image 32 that displays a time series of a plurality of phonemes constituting the synthetic speech to the user, and a feature profile image 34 that displays a time variation in a feature of the synthetic speech. The phoneme sequence image 32 and the feature profile image 34 are arranged commonly based on the time base (horizontal axis) 52. The first embodiment shows a pitch of the synthetic speech as a feature displayed by the feature profile image 34.

The phoneme sequence image 32 includes phoneme indicators 42 that respectively represent phonemes of the synthetic speech, which are arranged in a time series in the direction of the time base 52. The position (for example, a left end point of one phoneme indicator 42) of one phoneme indicator 42 in the direction of the time base 52 is the start point of sounding of each phoneme, and a length of one phoneme indicator 42 in the direction of the time base 52 means a time length (hereinafter referred to as a 'duration') for which sounding of each phoneme continues. The user can instruct the phoneme sequence image 32 to be edited by appropriately manipulating the input device 14 while confirming the edit screen 30. For example, the user instructs that a phoneme indicator 42 be added to an arbitrary point on the phoneme sequence image 32, the existing phoneme indicator 42 be deleted, a phoneme for a specific phoneme indicator 42 be designated, or a designated phoneme be changed. The display controller 22 updates the phoneme sequence image 32 depending on an instruction from the user for the phoneme sequence image 32.

The feature profile image 34 shown in FIG. 2 represents a transition line 56 that represents a time variation (trace) in the pitch of the synthetic speech on a plane for which the time base 52 and a pitch base (vertical axis) 54 are set. The transition line 56 is a broken line that connects a plurality of editing points (break points) arranged in a time series on the time base 52. The user can instruct the feature profile image 34 to be edited by appropriately manipulating the input device 14 while confirming the edit screen 30. For example, the user instructs that an editing point α be added to an arbitrary point on the feature profile image 34, or the existing editing point α be moved or deleted. The display controller 22 updates the feature profile image 34 depending on an instruction from the user for the feature profile image 34. For example, when the user instructs an editing point α to be moved, the feature profile image 34 is renewed to move the editing point α of the feature profile image 34 and renew the transition line 56 such that the transition line 56 passes through the moved editing point α.

Figure 3:
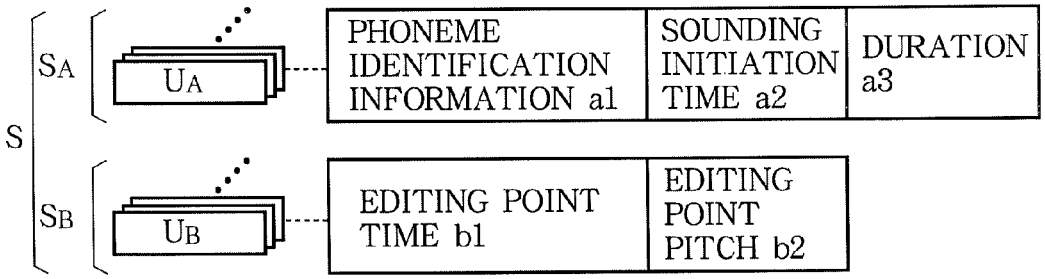
FIG. 3 is a schematic diagram of speech synthesis information (phoneme information, feature information).

The edition processor 24 shown in FIG. 1 generates speech synthesis information S corresponding to the contents of the edit screen 30, stores the speech synthesis information S in the storage device 12, and renews the speech synthesis information S at the direction of the user to edit the edit screen 30. FIG. 3 is a schematic diagram of the speech synthesis information S. As shown in FIG. 3, the speech synthesis information S includes phoneme information SA corresponding to the phoneme sequence image 32 and feature information SB corresponding to the feature profile image 34.

The phoneme information SA designates a time series of phonemes constituting the synthetic speech, and is composed of a time series of unit information UA corresponding to each phoneme set to the phoneme sequence image 32. The unit information UA specifies identification information a1 of a phoneme, a sounding initiation time a2, and a duration (that is, a duration for which sounding of a phoneme continues) a3. The edition processor 24 adds unit information UA corresponding to a phoneme indicator 42 to the phoneme information SA when the phoneme indicator 42 is added to the phoneme sequence image 32, and updates the unit information UA according to an instruction of the user. Specifically, the edition processor 24 sets identification information a1 of a phoneme designated by each phoneme indicator 42 for unit information UA corresponding to each phoneme indicator 42, and sets the sounding initiation time a2 and duration a3 depending on the position and length of the phoneme indicator 42 in the direction of the time base 52. It is possible to employ a configuration in which the unit information UA includes a sounding initiation time and end time (a configuration in which a time between the sounding initiation time and end time is specified as the duration a3).

The feature information SB designates a time variation in the pitch (feature) of the synthetic speech, and is composed of a time series of a plurality of unit information items UB corresponding to different editing points α of the feature profile image 34, as shown in FIG. 3. Each unit information UB specifies time b1 of an editing point α and a pitch b2 allocated to the editing point α. The edition processor 24 adds unit information UB corresponding to an editing point α to the feature information SB when the editing point α is added to the feature profile image 34, and updates the unit information UB according to an instruction of the user. Specifically, the edition processor 24 sets the time b1 depending on the position of each editing point α on the time base 52 for unit information UB corresponding to the editing point α, and sets the pitch b2 depending on the position of the editing point α on the pitch base 54.

The speech synthesis unit 26 shown in FIG. 1 generates the speech signal X of the synthetic speech designated by the speech synthesis information S stored in the storage device 12. Specifically, the speech synthesis unit 26 sequentially acquires element data corresponding to identification information a1 designated by the unit information UA of the phoneme information SA of the speech synthesis information S from the speech element group V, adjusts the element data into the duration a3 of the unit information UA and the pitch b2 represented by the unit information UB of the feature information SB, connects the element data items, and arranges the element data in sounding initiation time a2 of the unit information UA, thereby generating the speech signal X. Generation of the speech signal X according to the speech synthesis unit 26 is executed when the user who designates the synthetic speech with reference to the edit screen 30 instructs speech synthesis to be performed by manipulating the input device 14. The speech signal X generated by the speech synthesis unit 26 is supplied to the sound output device 18 and reproduced as a sound wave.

Figure 4:
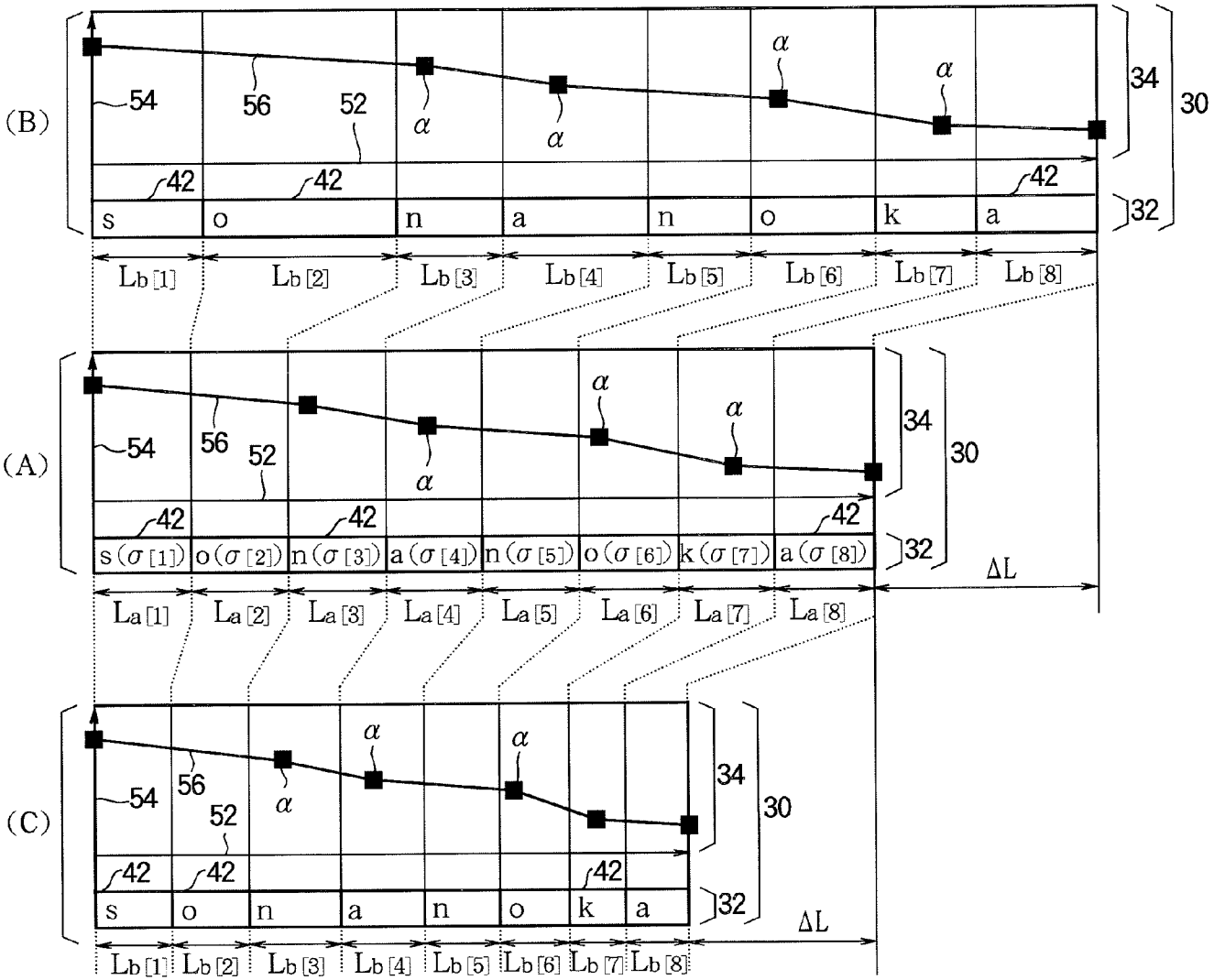
FIG. 4 is a diagram for explaining a procedure of expanding/compressing synthetic speech.

When the time series of the phoneme indicators 42 of the phoneme sequence image 32 and the time series of the editing points α of the feature profile image 34 are designated, it is possible to specify an arbitrary interval (hereinafter, referred to as a target expansion/compression interval) containing phase-continuous multiple (N) phonemes by manipulating the input device 14 and, simultaneously, instruct the target expansion/compression interval to be expanded or compressed. FIG. 4(A) shows an edit screen 30 in which the user designates a time series (/s/, /o/, /n/, /a/, /n/, /o/, /k/, /a/) of eight (N=8) phonemes σ[1] to σ[N] corresponding to a pronunciation "sonanoka" as the target expansion/compression interval. It is considered that the N phonemes σ[1] to σ[N] in the target expansion/compression interval have the same duration a3 in FIG. 4(A) for convenience.

When speech is expanded or compressed in case of real generation of voice (for example, in case of conversation), a tendency to vary a degree of expansion/compression depending on the pitch of the speech is grasped empirically.

Specifically, a high-pitch portion (a portion that needs to be emphasized in a conversation, typically) is expanded and a low-pitch portion (for example, a less emphasized portion) is compressed. In view of the above tendency, the duration a3 (the length of the phoneme indicator 42) of each phoneme in the target expansion/compression interval is increased/decreased to a degree depending on a pitch b2 allocated to the phoneme. Furthermore, considering that a vowel is easily expanded and compressed as compared to a consonant, a vowel phoneme is compressed and expanded more significantly than a consonant phoneme. Expansion/compression of each phoneme in the target expansion/compression interval will now be described in detail.

FIG. 4(B) shows an edit screen 30 when the target expansion/compression interval shown in FIG. 4(A) is expanded. When the user instructs the target expansion/compression interval to be expanded, phonemes in the target expansion/compression interval are expanded in such a manner that a degree of expansion increases as a pitch b2 designated by the feature information SB becomes higher, and a vowel phoneme is expanded to a high degree compared to a consonant phoneme in the target expansion/compression interval, as shown in FIG. 4(B). For example, a pitch b2 of a second phoneme σ[2], designated by the feature information SB, is higher than that of a sixth phoneme σ[6] while the phoneme σ[6] and the phoneme σ[2] have the same type /o/ in FIG. 4(B), and thus the second phoneme σ[2] is expanded to a duration a3 (=Lb[2]) longer than a duration a3 (=Lb[6]) of the sixth phoneme σ[6]. Furthermore, since the phoneme σ[2] is a vowel /o/ whereas a third phoneme σ[3] is a consonant /n/, the phoneme σ[2] is expanded to a duration a3(=Lb[2]) longer than a duration a3 (=Lb[3]) of the phoneme σ[3].

FIG. 4(C) shows an edit screen 30 in which the target expansion/compression interval shown in FIG. 4(A) is compressed. When the user instructs the target expansion/compression interval to be compressed, the phonemes in the target expansion/compression interval are compressed in such a manner that a degree of compression increases as a pitch b2 designated by the feature information SB becomes lower, and a vowel phoneme is compressed to a high degree as compared to a consonant phoneme in the target expansion/compression interval, as shown in FIG. 4(C). For example, a pitch b2 of a phoneme σ[6] is lower than that of a phoneme σ[2], and thus the phoneme σ[6] is compressed to a duration a3 (=Lb[6]) shorter than a duration a3 (=Lb[2]) of the phoneme σ[2]. Furthermore, the phoneme σ[2] is compressed to a duration a3 (=Lb[2]) shorter than a duration a3 (=Lb[3]) of the phoneme σ[3].

The above-mentioned operations performed by the edition processor 24 to expand and compress phonemes are described in detail below. When the target expansion/compression interval is instructed to be expanded, the edition processor 24 calculates an expansion/compression coefficient k[n] of an nth phoneme σ[n] (n=1 to N) according to the following Equation (1).

$$k(n)=La[n]\cdot R\cdot P[n] \tag{1}$$

A symbols La[n] in Equation (1) denotes the duration a3 designated by the unit information UA corresponding to a phoneme σ[n] before expanded, as shown in FIG. 4(A). A symbol R in Equation (1) denotes a phoneme expansion/compression rate which is previously set for each phoneme (per every phoneme type). The phoneme expansion/compression rate R (table) is selected in advance, and then stored in the storage device 12. The edition processor 24 searches the storage device 12 for the phoneme expansion/compression rate R corresponding to the phoneme σ[n] of the identification information a1 designated by the unit information UA and applies the phoneme expansion/compression rate R to a computation of Equation (1). The phoneme expansion/compression rate R of each phoneme is set in such a manner that a phoneme expansion/compression rate R of a vowel phoneme becomes higher than that of a consonant phoneme. Accordingly, an expansion/compression coefficient k[n] of a vowel phoneme is set to a value higher than that of a consonant phoneme.

A symbol P[n] in Equation (1) denotes a pitch of the phoneme σ[n]. For example, the edition processor 24 determines an average value of pitches indicated by the transition line 56 in a pronunciation interval of the phoneme σ[n], or a pitch at a specific point (for example, the start point or middle point) in the sounding interval of the phoneme σ[n] in the transition line 56 as the pitch P[n] of Equation (1), and then applies the determined value to the computation of Equation (1).

The edition processor 24 calculates an expansion/compression degree K[n] through a computation of the following Equation (2) to which the expansion/compression coefficient k[n] of Equation (1) is applied.

$$K[n]=k[n]/\Sigma(k[n]) \tag{2}$$

A symbol Σ(k[n]) in Equation (2) denotes the sum (Σ(k[n])=k[1]+k[2]+ . . . +k[N]) of expansion/compression coefficients k[n] for all (N) phonemes are involved in the target expansion/compression interval. That is, Equation (2) corresponds to a calculation for normalizing the expansion/compression coefficient k[n] to a positive number equal to or less than 1.

The edition processor 24 calculates a duration Lb[n] of the phoneme σ[n] after expanded through a computation of the following Equation (3) to which the expansion/compression degree K[n] of Equation (2) is applied.

$$Lb[n]=La[n]+K[n]\cdot\Delta L \quad (3)$$

A symbol ΔL in Equation (3) denotes an expansion/compression amount (absolute value) of the target expansion/compression interval and is set to a variable value according to a manipulation of the input device 14 by the user. As shown in FIGS. 4(A) and 4(B), the absolute value of a difference between a sum length Lb[1]+Lb[2]+ . . . +Lb[N] of the target expansion/compression interval after expanded and a sum length La[1]+La[2]+ . . . +La[N] of the target expansion/compression interval before expanded corresponds to the expansion/compression amount ΔL. As is understood from Equation (3), the expansion/compression degree K[n] means a ratio of a portion for expansion of the phoneme σ[n] to the overall expansion/compression amount ΔL of the target expansion/compression interval. As a result of the computation of Equation (3), the duration Lb[n] of each phoneme σ[n] after expanded is set in such a manner that a degree of expansion increases as a phoneme σ[n] has a high pitch P[n], and a vowel phoneme σ[n] is expanded to a degree higher than that of a consonant phoneme.

When the target expansion/compression interval is instructed to be compressed, the edition processor 24 calculates the expansion/compression coefficient k[n] of an nth phoneme σ[n] in the target expansion/compression interval according to the following Equation (4).

$$k[n]=La[n]\cdot R/P[n] \quad (4)$$

Meanings of variables La[n], R and P[n] in Equation (4) are identical to those in Equation (1). The edition processor 24 calculates the expansion/compression degree K[n] by applying the expansion/compression coefficient k[n] obtained through Equation (4) to Equation (2). As is understood from Equation (4), the expansion/compression degree K[n] (expansion/compression coefficient k[n]) of a phoneme σ[n] having a low pitch P[n] is set to a large value.

The edition processor 24 calculates a duration Lb[n] of the phoneme σ[n] after compressed through a computation of the following Equation (5) to which the expansion/compression degree K[n] is applied.

$$Lb[n]=La[n]-K[n]\cdot\Delta L \quad (5)$$

As is understood from equation (5), a duration Lb[n] of each phoneme σ[n] after compressed is set to a variable value such that a degree of compression increases as a phoneme σ[n] has a low pitch P[n], and a vowel phoneme σ[n] is compressed to a degree higher than that of a consonant phoneme.

Computations of the duration Lb[n] after expansion and compression have been described. When durations Lb[n] for the N phonemes σ[1] through σ[N] in the target expansion/compression interval are calculated through the above-mentioned procedure, the edition processor 24 changes a duration a3 designated by unit information UA corresponding to each phoneme σ[n] among the phoneme information SA from a duration La[n] before expanded/compressed to a duration Lb[n] (a calculation value of Equation (3) or (5)) after expanded/compressed, and updates a sounding initiation time a2 of each phoneme σ[n] for the duration a3 of each phoneme σ[n] after expanded/compressed. Furthermore, the display controller 22 changes the phoneme sequence image 32 of the edit screen 30 to contents corresponding to phoneme information SA after renewing by the edition processor 24.

As shown in FIGS. 4(B) and 4(C), the edition processor 24 updates the feature information SB, and the display controller 22 updates the feature profile image 34 such that a position of an editing point α relative to the sounding interval of each phoneme σ[n] is maintained before and after expansion/compression of the target expansion/compression interval. In other words, time b1 corresponding to an editing point α designated by the feature information SB is appropriately or proportionally changed such that a relationship between the time b1 and the sounding interval of each phoneme σ[n] before expansion/compression is maintained after expansion/compression. Accordingly, the transition line 56 specified by editing points α is expanded/compressed such that it corresponds to expansion/compression of each phoneme σ[n].

In the above-mentioned first embodiment, the expansion/compression degree K[n] of each phoneme σ[n] is variably set depending on the pitch [Pn] of each phoneme σ[n]. Accordingly, it is possible to generate speech synthesis information S capable of synthesizing auditorily natural speech (furthermore, generate natural speech using the speech synthesis information S) as compared to the configuration disclosed in Japanese Patent Application Publication No. Hei06-67685 in which the expansion/compression degree K[n] is set only based on phoneme type (vowel/consonant).

Specifically, natural speech to which a tendency to expand a phoneme to a higher degree as the pitch of the phoneme increases is applied when the target expansion/compression interval is expanded, and natural speech to which a tendency to compress a phoneme to a higher degree as the pitch of the phoneme decreases is applied when the target expansion/compression interval is compressed, are generated.

B: Second Embodiment

A second embodiment of the invention will now be explained. The second embodiment is based on edition of a time series (transition line 56 representing a time variation in a pitch) of editing points α designated by the feature information SB. In the following aspects, detailed explanations of components having the same operation and function as those of the first embodiment are appropriately omitted using symbols referred in the above explanation. An operation when the time series of phonemes is instructed to be expanded/compressed corresponds to the first embodiment.

Figure 5:
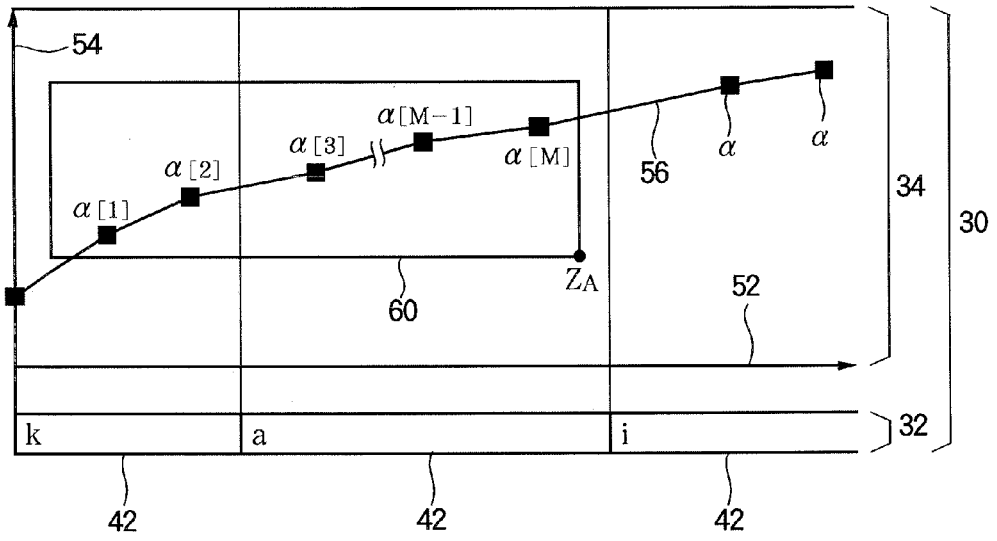
FIGS. 5(A) and 5(B) are diagrams for explaining a procedure of editing a time series of editing points according to a second embodiment.
Figure 5:
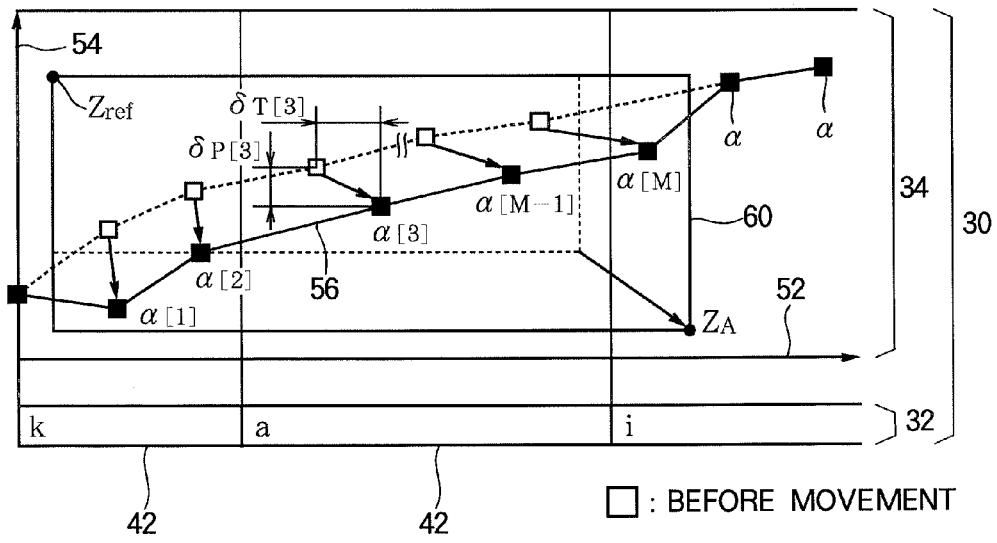

FIGS. 5(A) and 5(B) are diagrams for explaining a procedure of editing a time series (transition line 56) of a plurality of editing points α. FIG. 5(A) illustrates a time series of a plurality of phonemes /k/, /a/, /i/ corresponding to a pronunciation "kai" and a time variation in a pitch, which are designated by the user. The user designates a rectangular area 60 (hereinafter, referred to as a "selected area") to be edited in the feature profile image 34 by appropriately manipulating the input device 14. The selected area 60 is designated such that it includes a plurality of (M) neighboring editing points α[1] to α[M].

As shown in FIG. 5(B), the user can move a corner ZA of the selected area 60, for example, by manipulating the input device 14 so as to expand/compress (expand in case of FIG. 5(B)) the selected area 60. When the user expands/compresses the selected area 60, the edition processor 24 updates the feature information SB and the display controller 22 updates the feature profile image 34 such that the M editing points α[1] to α[M] involved in the selected area 60 are moved in response to expansion/compression of the selected area 60 (that is, the M editing points α[1] to α[M] are distributed in the expanded/compressed selected area 60). Since expansion/compression of the selected area 60 is an edition for the purpose of renewing the transition line 56, the duration a3 (the length of each phoneme indicator 42 in the phoneme sequence image 32) of each phoneme is not changed.

Movement of each editing point α when the selected area 60 is expanded or compressed will now be explained in detail. Although the following description is based on movement of an mth editing point α[m] as shown in FIG. 6, the M editing points α[1] to α[M] in the selected area 60 are moved according to the same rule, in practice, as shown in FIG. 5(B).

Figure 6:
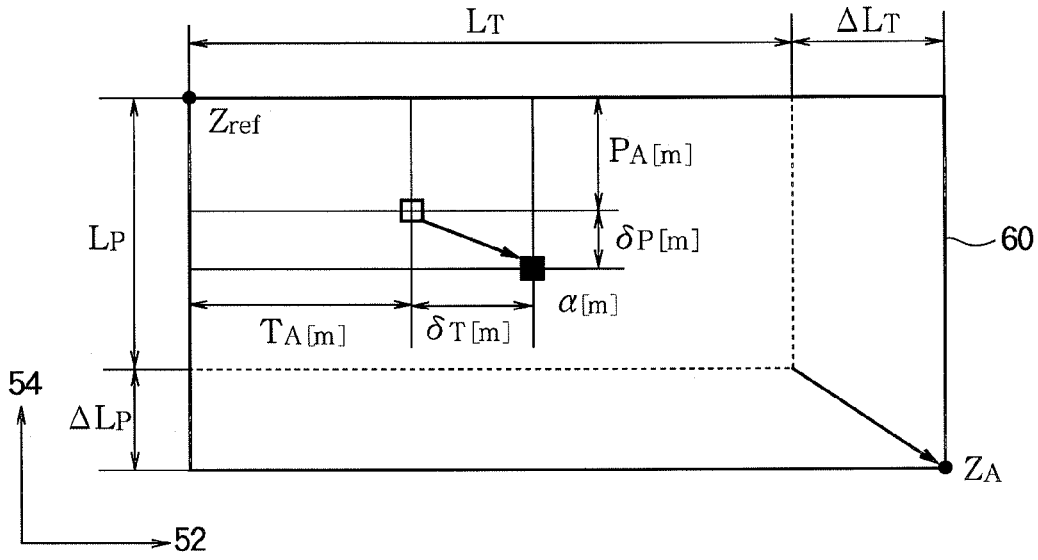
FIG. 6 is a diagram for explaining movement of an editing point.

As shown in FIG. 6, the user can move a corner ZA of the selected area 60 by manipulating the input device 14 to expand or compress (expand in case of FIG. 6) the selected area 60 while fixing a corner Zref (hereinafter referred to as a 'reference point') opposite to the corner ZA.

Specifically, it is assumed that a length LP of the selected area 60 in the direction of a pitch base 54 is expanded by an expansion/compression ΔLP and a length LT of the selected area 60 in the direction of the time base 52 is expanded by an expansion/compression ΔLT.

The edition processor 24 calculates a movement amount δP[m] of an editing point α[m] in the direction of the pitch base 54 and a movement amount δT[m] of the editing point α[m] in the direction of the time base 52. In FIG. 6, a pitch difference PA[m] means a pitch difference between the editing point α[m] and the reference point Zref before movement and a time difference TA[m] means a time difference between the editing point α[m] and the reference point Zref before movement.

The edition processor 24 calculates the movement amount 6P[m] through a computation of the following Equation (6).

$$\delta P[m]=PA[m]\cdot\Delta LP/LP \tag{6}$$

That is, the movement amount δP[m] of the editing point α[m] in the direction of the pitch base 54 is variably set depending on the pitch difference PA[m] before movement with respect to the reference point Zref and a degree (ΔLP/LP) of expansion/compression of the selected area 60 in the direction of the pitch base 54.

Furthermore, the edition processor 24 calculates the movement amount δT[m] through a computation of the following Equation (7).

$$\delta T[m]=R\cdot TA[m]\cdot\Delta LT/LT \tag{7}$$

That is, the movement amount δT[m] of the editing point α[m] in the direction of the time base 52 is variably set depending on a phoneme expansion/compression rate R in addition to the time difference TA[m] before movement with respect to the reference point Zref and a degree (ΔLT/LT) of expansion/compression of the selected area 60 in the direction of the time base 52.

AS does in the first embodiment, the phoneme expansion/compression rate R of each phoneme is stored in the storage device 12 in advance. The edition processor 24 searches the storage device 12 for a phoneme expansion/compression rate R corresponding to one phoneme including the editing point α[m] before moved in a sounding interval from among a plurality of phonemes designated by the phoneme information SA, and applies the searched phoneme expansion/compression rate to the computation of Equation (7). As does in the first embodiment, a phoneme expansion/compression rate R for each phone is set such that a phoneme expansion/compression rate of a vowel phoneme is higher than that of a consonant phoneme. Accordingly, if the time difference TA[m] for the reference point Zref or the degree ΔLT/LT of expansion/compression of the selected area 60 in the direction of the time base 52 are constant, the movement amount δT[m] of the editing point α[m] in the direction of the time base 52 in the case where the editing point α[m] corresponding to a vowel phoneme is greater than that in the case where the editing point α[m] corresponds to a consonant phoneme.

When the movement amount 6P[m] and the movement amount δT[m] are calculated for each of the M editing points α[1] to α[M] in the selected area 60, the edition processor 24 updates the unit information UB such that each editing point α[m] designated by the unit information UB of the feature information SB is moved by the movement amount 6P[m] in the direction of the pitch base 54 and, simultaneously, moved by the movement amount δT[m] in the direction of the time base 52. Specifically, as is understood from FIG. 6, the edition processor 24 adds the movement amount δT[m] of Equation (7) at a time b1 designated by the unit information UB of the editing point α[m] among the feature information SB, and subtracts the movement amount 6P[m] of Equation (6) from a pitch b2 designated by the unit information UB. The display controller 22 updates the feature profile image 34 of the edit screen 30 to contents depending on the feature information SB after renewal by the edition processor 24. That is, the M editing points α[1] to α[M] in the selected area 60 are moved and the transition line 56 is renewed such that it passes through the moved editing points α[1] to α[M], as shown in FIG. 5(B).

As described above, editing points α[m] are moved by the movement amount δT[m] depending on phoneme type (phoneme expansion/compression rate R) in the direction of the time base 52 in the second embodiment. That is, as shown in FIG. 5(B), editing points α[m] corresponding to vowel phonemes /a/ and /i/ are moved in the direction of the time base 52 depending on expansion/compression of the selected area 60 to a high degree as compared to editing points α[m] corresponding to a consonant phoneme /k/. Accordingly, it is possible to achieve a complicated edition for moving editing points α[m] corresponding to vowel phonemes while restricting movement of editing points α[m] corresponding to consonant phonemes on the time base 52 through a simple operation of expanding or compressing the selected area 60.

While the above examples include both the configuration of the first embodiment in which each phoneme α[n] is expanded/compressed depending on a pitch P[n] and the configuration of the second embodiment in which editing points α[m] are moved based on phoneme type, the configuration (expansion/compression of each phoneme) of the first embodiment may be omitted.

Meanwhile, when each editing point α is moved through the above-mentioned method, there is a possibility that positions of an editing point α arranged in proximity to an edge of the selected area 60 (for example, an editing point α[M] in FIG. 5(B)) and an editing point α outside the selected area 60 (for example, a second editing point α from the right in FIG. 5(B)) on the time base 52 is changed before and after expansion/compression of the selected area 60. In addition, even in the inside of the selected area 60, positions of editing points α may be changed before and after expansion/compression of the selected area 60 due to a difference between phoneme expansion/compression rates R of the phonemes (for example, when an expansion/compression rate R of a phoneme corresponding to a front editing point α is sufficiently higher than that of a phoneme corresponding to a rear editing point α). Accordingly, it is preferable to set constraints that a positional or sequential relationship between editing points α on the time base 52 is not changed before and after expansion/compression of the selected area 60. Specifically, the movement amount δT[m] of Equation (7) is calculated such that constraints of the following Equation (7a) are accomplished.

$$TA[m-1]+\delta T[m-1] \leq TA[m]+\delta T[m] \quad (7a)$$

For example, it is possible to appropriately employ a configuration in which expansion/compression of the selected area 60 by the user is limited within a range in which the constraints of Equation (7a), a configuration in which a phoneme expansion/compression rate R corresponding to each editing point α is dynamically adjusted such that the constraints of Equation (7a) are accomplished, or a configuration in which the movement amount δT[m] calculated by Equation (7) is corrected such that the constraints of Equation (7a) are accomplished.

C: Modifications

The aforementioned embodiments may be modified in various manners. Detailed aspects of modifications will be described below. Two or more aspects arbitrarily selected from the following examples may be combined.

(1) Modification 1

While each phoneme σ[n] is expanded or compressed depending on its pitch P[n] in the first embodiment, the feature of the synthetic speech, which is reflected in the expansion/compression degree K[n] of each phoneme, is not limited to the pitch P[n]. For example, on the assumption that a degree of expansion/compression of phonemes is varied with a dynamics of speech (for example, a large-dynamics portion is easily expanded), a configuration in which the feature information SB is generated such that it designates a time variation in a dynamics or volume, and a pitch P[n] of each computation described in the first embodiment is substituted with dynamics D[n] represented by the feature information SB is employed. That is, the expansion/compression degree K[n] is variably set depending on the dynamics D[n] such that a phoneme σ[n] with a large dynamics D[n] is expanded to a high degree and a phoneme σ[n] with a small dynamics D[n] is compressed to a high degree. Articulation of speech may be considered as a feature suitable to calculate the expansion/compression degree K[n] in addition to the pitch P[n] and dynamics D[n].

(2) Modification 2

While the expansion/compression degree K[n] is set for each phoneme in the first embodiment, there may be a case in which individual expansion/compression of each phoneme is not appropriate. For example, if former three phonemes /s/, /t/ and /r/ of a word "string" are expanded or compressed with different expansion/compression degrees K[n], the resulting speech can be unnatural. Accordingly, it is possible to employ a configuration in which expansion/compression degrees K[n] of specific phonemes (for example, phonemes selected by the user or phonemes that satisfy a predetermined condition) in a target expansion/compression interval are set to the same value. For example, when three or more consonant phonemes continue, their expansion/compression degrees K[n] are set to the same value.

(3) Modification 3

There is a possibility that the phoneme expansion/compression rate R applied to Equation (1) or (4) is abruptly changed between adjacent phonemes σ[n−1] and σ[n] in the first embodiment. Accordingly, it is preferable to employ a configuration in which a moving average of phoneme expansion rates R over a plurality of phonemes (for example, an average of the phoneme expansion/compression rate R of the phoneme σ[n−1] and the phoneme expansion/compression rate R of the phoneme σ[n]) is used as the phoneme expansion/compression rate R of Equation (1) or Equation (4). For the second embodiment, a configuration in which a moving average of phoneme expansion/compression rates R determined for editing points α[m] is applied to the computation of Equation (7) may be employed.

(4) Modification 4

While a pitch calculated from the feature information SB is directly applied as the pitch of Equation (1) or Equation (4) in the first embodiment, it is possible to employ a configuration in which the pitch P[n] is calculated through a predetermined calculation performed on a pitch p specified by the feature information SB. For example, it is preferable to employ a configuration in which exponentiation of the pitch p (for example, $p^2$) is used as the pitch P[n] or a configuration in which the algebraic or logarithmic value of the pitch p (log p) is used as the pitch P[n].

(5) Modification 5

While the phoneme information SA and the feature information SB are stored in the single storage device 12 in the above embodiments, it is possible to employ a configuration in which the phoneme information SA and the feature information SB are respectively stored in separate storage devices 12. That is, the present invention overlooks separation/integration of an element (phoneme storage unit) that stores the phoneme information SA and an element (feature storage unit) that stores the feature information SB.

(6) Modification 6

While the speech synthesis apparatus 100 including the speech synthesis unit 26 is described in the above embodiments, the display controller 22 or the speech synthesis unit 26 may be omitted. In a configuration in which the display controller 22 is omitted (a configuration in which display of the edit screen 30 or an instruction from the user to edit the edit screen 30 is omitted), generation and edition of the speech synthesis information S are automatically executed without requiring an instruction from the user for edition. It is preferred to on/off creation and edition of the speech synthesis information S according to the edition processor 24 depending on an instruction from the user in the above-mentioned configurations.

Furthermore, in an apparatus in which the display controller 22 or the speech synthesis unit 26 is omitted, the edition processor 24 may be configured as a device (speech synthesis information editing device) that creates and edits the speech synthesis information S. The speech synthesis information S generated by the speech synthesis information editing device is provided to a separate speech synthesis apparatus (speech synthesis unit 26) so as to generate the speech signal X. For example, in a communication system in which a speech synthesis information editing device (server device) including the storage device 12 and the edition processor 24 and a communication terminal (for example, a personal computer or a portable communication terminal) including the display controller 22 or the speech synthesis unit 26 communicate with each other via a communication network, the present invention is applied to a case in which a service (cloud computing service) of creating and editing the speech synthesis information S is provided from the speech synthesis information editing device to the terminal. That is, the edition processor 24 of the speech synthesis information editing apparatus generates and edits the speech synthesis information S at the request from the communication terminal and transmits the speech synthesis information S to the communication terminal.

What is claimed is:

1. A speech synthesis information editing apparatus comprising:

a phoneme storage unit configured to store phoneme information that designates a duration of each phoneme of speech to be synthesized;

a feature storage unit configured to store feature information that designates a time variation in a feature of the speech;

an expansion/compression rate storage unit configured to store a phoneme expansion/compression rate that is set for each phoneme;

an edition processing unit configured to change a duration of each phoneme designated by the phoneme information in accordance with an expansion/compression degree that is provided for each phoneme, wherein the expansion/compression degree is obtained according to the feature designated by the feature information for the phoneme and the phoneme expansion/compression rate that corresponds to the phoneme; and a display control unit configured to display a phoneme indicator having a length set according to the duration of each phoneme designated by the phoneme information, and configured to update the displayed length of the phoneme indicator based on the duration of each phoneme changed by the edition processing unit.

2. The speech synthesis information editing apparatus according to claim 1, wherein the feature designated by the feature information is a pitch, and the edition processing unit is configured to set the expansion/compression degree to be variable depending on the feature when the speech is expanded, such that a degree of expansion of the duration of the phoneme increases as a pitch of the phoneme designated by the feature information becomes higher.

3. The speech synthesis information editing apparatus according to claim 1, wherein the feature designated by the feature information is a pitch, and the edition processing unit is configured to set the expansion/compression degree to be variable depending on the feature when the speech is compressed, such that a degree of compression of the duration of the phoneme increases as a pitch of the phoneme designated by the feature information becomes lower.

4. The speech synthesis information editing apparatus according to claim 1, wherein the feature designated by the feature information is a volume, and the edition processing unit is configured to set the expansion/compression degree to be variable depending on the feature when the speech is expanded, such that a degree of expansion of the duration of the phoneme increases as a volume of the phoneme designated by the feature information becomes greater.

5. The speech synthesis information editing apparatus according to claim 1, wherein the feature designated by the feature information is a volume, and the edition processing unit is configured to set the expansion/compression degree to be variable depending on the feature when the speech is compressed, such that a degree of compression of the duration of the phoneme increases as a volume of the phoneme designated by the feature information becomes smaller.

6. The speech synthesis information editing apparatus according to claim 1, wherein the display control unit is configured to display an edit screen containing a phoneme sequence image and a feature profile image on a display device, the phoneme sequence image being a sequence of phoneme indicators arranged along a time base in correspondence to the phonemes of the speech, the feature profile image representing a time series of the feature designated by the feature information and arranged along the same time base, and is configured to update the edit screen based on a processing result of the edition processing unit.

7. The speech synthesis information editing apparatus according to claim 1, wherein the feature information specifies the feature for each of a plurality of editing points of the phonemes arranged on a time base, and the edition processing unit is configured to update the feature information such that a position of the editing point relative to a sounding interval of the phoneme is maintained before and after change of the duration of each phoneme.

8. The speech synthesis information editing apparatus according to claim 7, wherein the edition processing unit is configured to move a position of the editing point on the time base within the sounding interval of the phoneme represented by the phoneme information by an amount depending on a type of the phoneme when the time variation in the feature is updated.

9. The speech synthesis information editing apparatus according to claim 8, wherein the edition processing unit is configured to move a position of the editing point within the sounding interval of the phoneme by an amount depending on a type of the phoneme such that a movement amount of an editing point for a phoneme of vowel type is different from a movement amount of an editing point for a phoneme of consonant type.

10. The speech synthesis information editing apparatus according to claim 1, wherein the edition processing unit is configured to set the expansion/compression degree to a same value for specific ones of the phonemes designated by the phoneme information.

11. A machine readable non-transitory storage medium for use in a computer, the medium containing program instructions executable by the computer to perform a speech synthesis information editing process comprising:

providing phoneme information that designates a duration of each phoneme of speech to be synthesized;

providing feature information that designates a time variation in a feature of the speech;

providing a phoneme expansion/compression rate that is set for each phoneme; and changing a duration of each phoneme designated by the phoneme information in accordance with an expansion/compression degree that is provided for each phoneme, wherein the expansion/compression degree is obtained according to the feature designated by the feature information for the phoneme and the phoneme expansion/compression rate that corresponds to the phoneme; and outputting for display a phoneme indicator having a length set according to the duration of each phoneme designated by the phoneme information, and updating the displayed length of the phoneme indicator based on the duration of each phoneme changed by the edition processing unit.

12. A speech synthesis information editing method comprising:

providing, by a processor, phoneme information that designates a duration of each phoneme of speech to be synthesized;

providing, by the processor, feature information that designates a time variation in a feature of the speech;

providing, by the processor, a phoneme expansion/compression rate that is set for each phoneme; and changing, by the processor, a duration of each phoneme designated by the phoneme information in accordance with an expansion/compression degree that is provided for each phoneme, wherein the expansion/compression degree is obtained according to the feature designated by the feature information for the phoneme and the phoneme expansion/compression rate that corresponds to the phoneme; and outputting for display a phoneme indicator having a length set according to the duration of each phoneme designated by the phoneme information, and updating the displayed length of the phoneme indicator based on the duration of each phoneme changed by the edition processing unit.

13. The speech synthesis information editing apparatus according to claim 1, wherein:

the feature designated by the feature information is a pitch or a volume.

14. The speech synthesis information editing apparatus according to claim 1, wherein:

an expansion/compression coefficient is obtained according to a duration, the expansion/compression rate and a pitch, and the expansion/compression degree is a ratio of the expansion/compression coefficient to a sum of expansion/compression coefficients of phonemes involved in a target interval.

15. The machine readable non-transitory storage medium according to claim 11, wherein:

the feature designated by the feature information is a pitch or a volume.

16. The machine readable non-transitory storage medium according to claim 11, wherein:

an expansion/compression coefficient is obtained according to a duration, the expansion/compression rate and a pitch, and the expansion/compression degree is a ratio of the expansion/compression coefficient to a sum of expansion/compression coefficients of phonemes involved in a target interval.

17. The speech synthesis information editing method according to claim 12, wherein:

the feature designated by the feature information is a pitch or a volume.

18. The speech synthesis information editing method according to claim 12, wherein:

an expansion/compression coefficient is obtained according to a duration, the expansion/compression rate and a pitch, and the expansion/compression degree is a ratio of the expansion/compression coefficient to a sum of expansion/compression coefficients of phonemes involved in a target interval.

* * * * *